US005727435A

United States Patent [19]

Wentzek

[11] Patent Number: 5,727,435

[45] Date of Patent: Mar. 17, 1998

[54] SEVERANCE CONTROL FOR SINUOUS WIRE FORMING MACHINE

[75] Inventor: Horst F. Wentzek, Kenosha, Wis.

[73] Assignee: Frank L. Wells Company, Kenosha, Wis.

[21] Appl. No.: 698,481

[22] Filed: Aug. 15, 1996

Related U.S. Application Data

[63] Continuation of Ser. No. 190,672, Jan. 31, 1994, abandoned.

[51] Int. Cl.[6] ..... B21F 11/00

[52] U.S. Cl. ..... 83/208; 83/210; 83/363; 83/369; 83/907; 72/132

[58] Field of Search ..... 83/208, 210, 363, 83/364, 369, 907, 209; 72/17, 33, 131, 132; 225/100; 324/175; 140/139, 140, 71 C

[56] References Cited

U.S. PATENT DOCUMENTS

| | | | |
|---|---|---|---|
| 3,481,520 | 12/1969 | Pickering | 83/369 X |
| 3,654,830 | 4/1972 | Werner, Jr. | 83/208 |
| 3,715,944 | 2/1973 | Knechtel et al. | 83/208 X |
| 3,757,552 | 9/1973 | Ritter et al. | 83/69 X |
| 3,760,669 | 9/1973 | Rosenthal et al. | 83/210 X |
| 3,942,112 | 3/1976 | Westbrook | 324/175 X |
| 3,948,125 | 4/1976 | Hujer et al. | 83/210 X |
| 3,972,214 | 8/1976 | Jagersberger | 83/369 X |
| 3,978,703 | 9/1976 | Primich et al. | 83/210 X |
| 4,688,708 | 8/1987 | Irvine et al. | 225/100 |
| 5,007,270 | 4/1991 | Wallis | 72/17 X |

FOREIGN PATENT DOCUMENTS

| | | | |
|---|---|---|---|
| 1168782 | 7/1989 | Japan | 83/369 |

OTHER PUBLICATIONS

Frank L. Wells Company, "Sinuous Wire Forming . . . with unparalleled speed and flexibility . . . ".

*Primary Examiner*—Rinaldi I. Rada
*Assistant Examiner*—Clark F. Dexter
*Attorney, Agent, or Firm*—Michael, Best & Friedrich

[57] ABSTRACT

Apparatus for cutting, from a continuously extending sinuously formed wire, a variably selected predetermined length thereof having a plurality of sinuously formed generally identical coils, which apparatus comprises a frame, a mechanism on said frame for severing the sinuously formed wire, a track on said frame for guiding travel of the sinuously formed wire to the wire severing mechanism, and a control connected to the wire severing mechanism and including a sensing circuit for generating countable electrical pulses in response to wire travel relative to the wire severing mechanism, and a counting circuit operable to receive the countable electrical pulses and, in response to receipt of a predetermined number thereof, to generate an actuating signal effective to cause action of the wire severing mechanism to sever the wire.

3 Claims, 2 Drawing Sheets

SEVERANCE CONTROL FOR SINUOUS WIRE FORMING MACHINE

This is a Continuation of application Ser. No. 08/190,672, filed Jan. 31, 1994, Entitled "SEVERANCE CONTROL FOR SINUOUS WIRE FORMING MACHINE, now abandoned.

BACKGROUND OF THE INVENTION

The invention relates generally to sinuous wire forming machinery which forms a relatively straight wire into a continuously extending series of sinuously formed coils and which severs the wire into predetermined lengths having a selectively predetermined number of coils.

Such machines have, in the past, included means for forming a continuously extending generally straight wire into a series of sinuously formed coils and which, incident to such coil forming operation, causes movement or travel of the coiled wire through the machine. The past machine also included means for severing the wire, means for guiding the sinuously formed wire for passage to the severing means, and means, operable in response to the passage of a predetermined length of wire having a predetermined number of sinuously formed coils, for halting movement or passage of the sinuously formed wire to the severing means and for causing actuation of the severing means to sever the wire to produce a wire length having the predetermined number of coils.

In the past, the last mentioned means included an endless link chain which was moved in response to movement of the sinuously formed wire at the same rate of speed as the sinuously formed wire and had a length equal to the predetermined wire length or to any even multiple of such length.

The link chain carried one or more cams which, consequent to chain movement, engaged a trip, which engagement was effective to stop link chain movement, to stop passage of the sinuously formed wire, and to actuate the severing means.

Also, in the past, operation of the severing means actuated an air operated plunger which pivoted the trip out of the path of cam travel, whereby to again afford continuation of the advancement of the link chain and the sinuously formed wire until the next engagement of a cam and the trip.

SUMMARY OF THE INVENTION

The invention provides apparatus for cutting, from a continuously extending sinuously formed wire, a variably selected predetermined length thereof having a plurality of sinuously formed coils, which apparatus comprises a frame, means on the frame for severing the sinuously formed wire, means on the frame for guiding travel of the sinuously formed wire to the wire severing means, and control means connected to the wire severing means and including means including a sensing circuit for generating countable electrical pulses in response to wire travel relative to the wire severing means, means for halting travel of the sinuously formed wire to the wire severing means and including a magnetic brake operable, incident to energization thereof, to prevent wire travel to the wire severing means and operable, incident to the absence of energization thereof, to permit wire travel to the wire severing means, and means including a counting circuit operable to receive the countable electrical pulses and, in response to receipt of a predetermined number thereof, to generate an actuating signal effective to cause energization of the magnetic brake means to prevent wire travel to the wire severing means and to generate an actuating signal effective to cause actuation of the wire severing means to sever the wire.

The invention also provides apparatus for cutting, from a continuously extending sinuously formed wire, a variably selected predetermined length thereof having a plurality of sinuously formed generally identical coils, which apparatus comprises a frame, means on the frame for severing the sinuously formed wire, means on the frame for guiding travel of the sinuously formed wire to the wire severing means, and control means connected to the wire severing means and including means for generating countable electrical pulses in response to wire travel relative to the wire severing means, which pulse generating means includes a sprocket which is rotatably supported by the frame and which is rotatable in accordance with wire travel relative to the wire severing means, which sprocket includes a plurality of angularly spaced teeth, a magnetic sensing mechanism supported by the frame adjacent the sprocket and operable, in response to passage therepast of the sprocket, to generate an electrical signal, which magnetic sensing mechanism includes first and second magnetic sensors, supported on the frame and in angularly spaced relation to each other corresponding to the angular spacing of the sprocket teeth, and a sensing circuit operable to generate a countable electrical pulse in response to receipt of signals from the first and second magnetic sensors, and means operable to receive the countable electrical pulses and, in response to receipt of a predetermined number thereof, for generating actuating signals effective to halt travel of the sinuously formed wire to the wire sensing means, and to cause actuation of the wire severing means to sever the wire, which signal generating means includes a magnetic brake operable, incident to energization thereof in response to an actuating signal, to prevent rotation of the sprocket and operable, incident to the absence of energization thereof, to permit sprocket rotation in accordance with advancement of the wire relative to the wire severing means, and a counting circuit operable to generate actuating signals for energizing the magnetic brake means and the wire severing means in response to receipt of a predetermined number of countable pulses.

Other features and advantages of the invention will become apparent to those skilled in the art upon review of the following detailed description, claims, and drawings.

Figure 1:
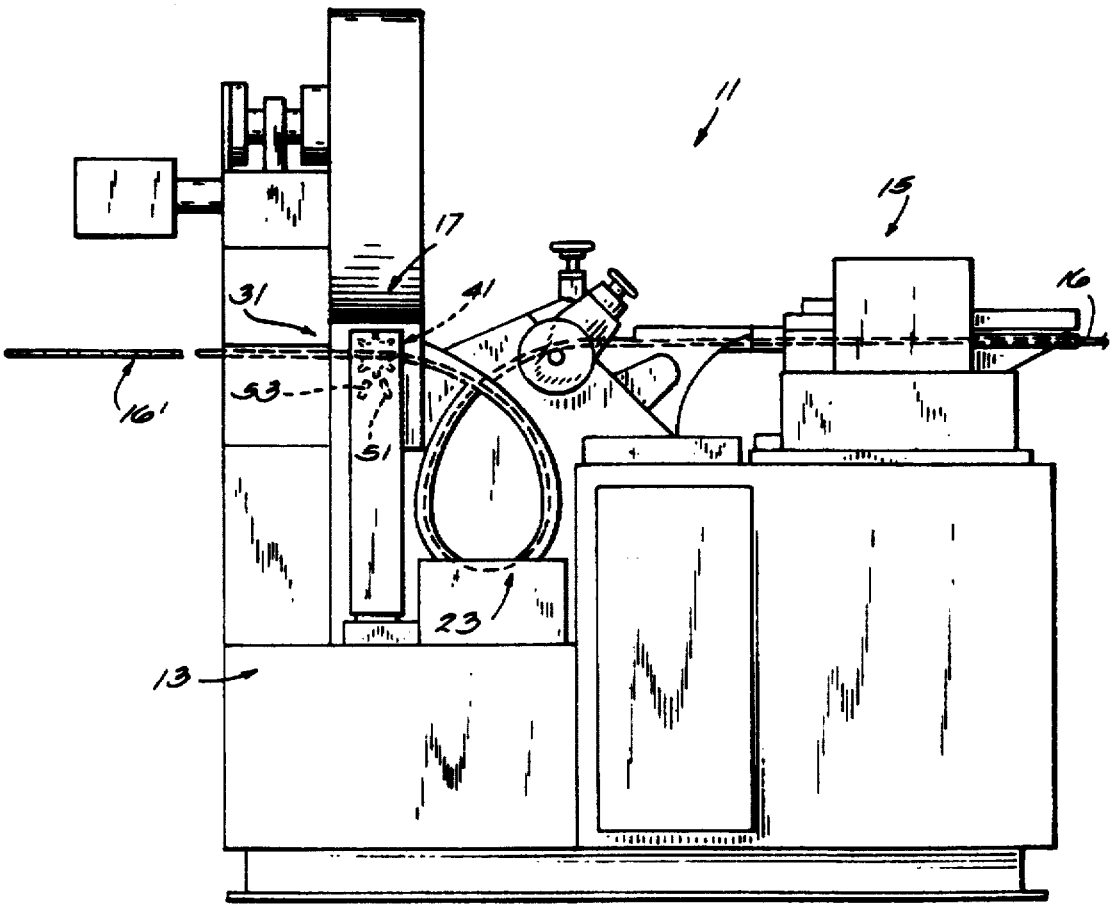
FIG. 1 is an elevational view of a sinuous wire forming machine including control means embodying various features of the invention.

Before one embodiment of the invention is explained in detail, it is to be understood that the invention is not limited in its application to the details of the construction and the arrangements of components set forth in the following description or illustrated in the drawings. The invention is capable of other embodiments and Of being practiced or being carried out in various ways. Also, it is to be understood that the phraseology and terminology used herein is for the purpose of description and should not be regarded as limiting.

GENERAL DESCRIPTION

Figure 2:
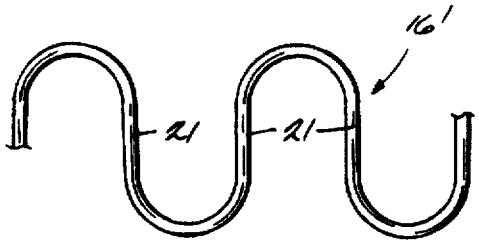
FIG. 2 is a fragmentary view of a portion of a sinuously formed wire.

Shown in FIG. 1 of the drawings is a sinuous wire forming machine 11 which includes a frame 13, and means 15 which is supported by the frame 13 and which is operable to form continuously extending generally straight wire 16 into a series of sinuously formed coils 19 and which, incident to such coil forming operation, causes movement or travel of the sinuously formed or coiled wire 16' through the machine. Any suitable construction can be employed. The machine also includes means 17 on the frame 13 for severing the sinuously formed wire 16' into predetermined lengths each having (see FIG. 2) a predetermined number of sinuously formed coils 19 respectively including cross bars 21. Any suitable construction can be employed.

The machine 11 also includes guide means 23, which is supported by the frame 13 and which is in the form of a track 25 extending between the coil forming means 15 and the wire severing means 17 for guiding movement or travel of the sinuously formed wire 16' from the coil forming means 15 to the wire severing means 17. Any suitable construction can be employed.

The machine 11 also includes one-way mechanical slip clutch means 39 supported by the frame 13, engaging the shaft 37 and operable to prevent rotation of the shaft 37 in the direction opposite to the direction of rotation caused by advancement of the sinuously formed wire 16' toward the wire severing means 17. The mechanical slip clutch means 39 thus substantially prevents movement of the sinuously formed wire 16' in the direction opposite to the direction of advancement toward the wire severing means 17 without interfering with such advancement. Any suitable construction can be employed.

The machine 11 also includes control means 31 which is supported on the frame 13 and which is operable to actuate the wire severing means 17 to provide variably predetermined lengths of sinuously formed wire. The control means 31 includes a sprocket 33 which includes a plurality of evenly angularly spaced teeth 35 extending into the track 25, and which is fixedly mounted on a shaft 37 supported on the frame 13 for rotation about an axis extending transversely to the direction of travel of the sinuously formed wire from the coil forming means 15 to the wire severing means 17. In particular, the sprocket 33 is sized and located so that the successive cross bars 21 of the sinuously formed wire 16' engage successive sprocket teeth 35 to cause rotation of the sprocket 33 and of the shaft 37 in response to passage of the sinuously formed wire 16'. Thus, the sprocket teeth 35 are angularly spaced to receive there between the cross bars 21 of the coils 19 of the sinuously formed wire 16' in such manner as to provide forward and reverse shaft rotation in correspondence with forward and reverse movement of the sinuously formed wire 16'.

The control means 31 also includes a second sprocket 41 which is fixedly mounted on the shaft 37, which includes a series of teeth 43 equal in number to the number of teeth 35 on the sprocket 33 and spaced along the periphery thereof in the same angular spacing as the spacing of the teeth 35 of the sprocket 33, and which, in the past, was engaged by the link chain referred to in the Background of the Invention. As thus far described, the construction is conventional and is known in the art.

Figure 3:
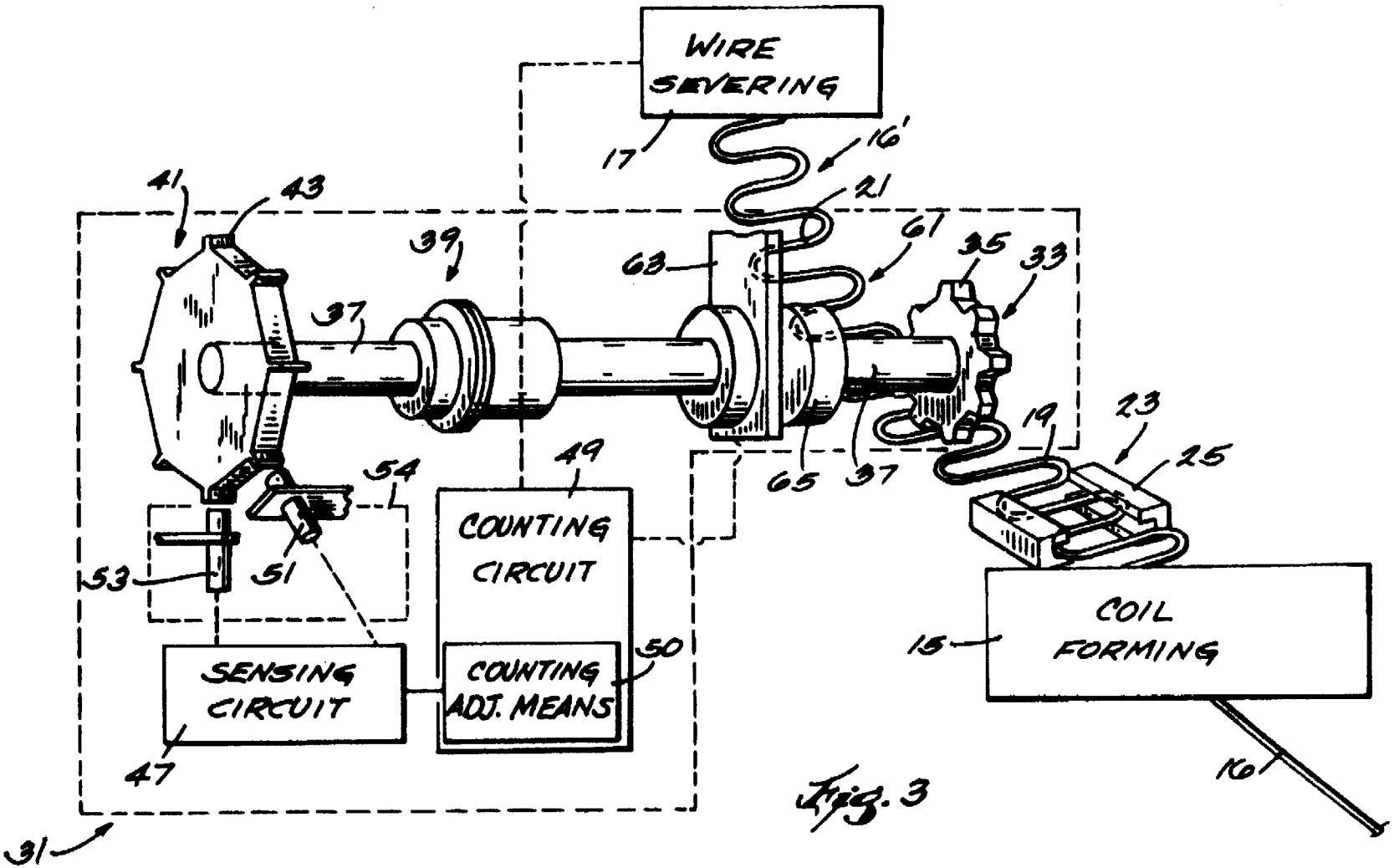
FIG. 3 is an exploded and partially fragmentary and partially schematic view of the sinuous wire forming machine shown in FIG. 1.

In the machine 11, as shown in FIG. 3, the control means 31 includes means including a sensing circuit 47 (shown schematically) for generating countable electrical pulses in response to wire travel relative to the wire severing means, and means including a counting circuit 49 operable to receive the countable electrical pulses and, in response to receipt of a predetermined number thereof, to generate an actuating signal effective to cause actuation of the wire severing means to sever the wire. While various other arrangements can be employed for generating such countable electrical pulses, in the disclosed construction, such pulse generating means 47 comprises (in addition to the sprockets 33 and 41, the shaft 37 and the slip clutch means 39), a magnetic sensing means or mechanism including a pair of magnetic sensors 51 and 53 which are supported by the frame 13 in position for passage therepast of the teeth 43 of the second sprocket 41. More specifically, the magnetic sensors 51 and 53 are supported at an angle to each other corresponding to the angular relationship between the teeth 43 on the second sprocket 41 and are adjustable radially relative to the second sprocket 41 to vary the duration of the signal generated thereby during passage therepast of the sprocket teeth 43. Any known suitable construction can be employed for adjustably mounting the sensors 51 and 53.

The control means 31 also includes means for halting travel of the sinuously formed wire 16' in response to a predetermined number of countable pulses. While other constructions can be employed, in the disclosed construction, such means for halting wire travel includes a one-way electromagnetic brake 61 which, when electrically actuated, serves to prevent or halt rotation of the shaft 37 in the direction corresponding to advancement of the sinuously formed wire 16'. Such halting of shaft rotation also halts advancement of the wire 16' toward the wire severing means 17 and thereby locates the wire relative to the wire severing means 17 in the proper position whereby severance of the wire 16' produces a wire length having the desired number of coils 19.

The magnetic brake 61 includes an armature 63 fixed to the frame 13 and a brake member 65 fixed to the shaft 37 and movable relative to and into engagement with the armature 63 to brake forward shaft rotation upon receipt of an actuating signal from the counting circuit 49. In the absence of such an actuating signal, the brake member 65 is normally spaced from the armature 63 and does not affect shaft rotation. Any suitable magnetic brake construction can be employed.

The sensing circuit 47 is arranged to generate a counting pulse in response to simultaneous receipt of signals from both of the magnetic sensors 51 and 53 or in response to discontinuation of both signals from the magnetic sensors 51 and 53 after previous simultaneous signal receipt from both the magnetic sensors 51 and 53. As indicated previously, the relative proximity of the magnetic sensors 51 and 53 to the sprocket teeth 43 determines the angular interval during which signals are generated as the sprocket 41 passes the magnetic sensors 51 and 53. The use of the two magnetic sensors 51 and 53 which, in response to common signal sending activity or common discontinuance of such signals, serves to eliminate double counting which might otherwise occur in response to vibration of the wire 16' with resulting oscillation of the shaft 37. Any suitable magnetic sensors can be employed.

The previously mentioned counting circuit 49 (shown schematically) is operable to count the receipt of counting pulses from the sensing circuit 47, and in response to receipt of a predetermined count, to generate actuating signals effective to energize the electromagnetic brake 61 and the wire severing means 17 through a single severing cycle. The counting circuit 49 also includes manually setable means 50 for variably adjusting the number of counting pulses required to generate the actuation signals so as thereby to variably and selectively produce wire lengths having variously predetermined number of coils.

The control means 31 also includes suitable means operable, after wire severance and in response to motion of the wire severing means 17, for de-energizing the electromagnetic brake 61.

It is believed that description of the details of the construction of the sensing and counting circuits 47 and 49 described herein, and the means for de-energizing the electromagnetic brake 61 is unnecessary as such construction is believed to be within ordinary skill in the applicable art and need not be otherwise described in detail.

In operation, the coil forming means 15 is operable to form the wire 16 into a continuous extending series of sinuously formed coils 19 and to cause advancement of the coiled wire 16' toward the wire severing means 17. Such advancement causes rotation of the sprocket 33 which, in turn, causes rotation of the sprocket 41 past the magnetic sensors 51 and 53. When energized by proximity of the sprocket teeth 43, the magnetic sensors 51 and 53 send signals to the sensing circuit 47 which, as already indicated, generates a counting pulse either in response to simultaneous receipt of signals from both sensors 51 and 53 or in response to discontinuance of such signals from both sensors after previous simultaneous receipt.

When the counting circuit 49 receives a predetermined number of counting pulses, the counting circuit 49 generates signals to energize the magnetic brake 61 to halt advancement of the wire 16' toward the wire severing means 17, and to cause operation of the wire severing means 17 through one cycle to sever the sinuously formed wire 16' and thereby provide a wire length with the desired number of coils 19. Thereafter, the magnetic brake 61 is de-energized and the advancement of the sinuously formed wire 16' to the wire severing means 17 is resumed.

As desired, the counting circuit 49 can be manually adjusted so as to generate the actuating signals after receipt of differing numbers of counting pulses.

Various features of the invention are set forth in the following claims.

I claim:

1. Apparatus for cutting, from a continuously extending sinuously formed wire, a variably selected predetermined length thereof having a plurality of sinuously formed generally identical coils, said apparatus comprising a frame, means on said frame operable through one cycle, incident to energization thereof, for severing the sinuously formed wire, means on said frame for guiding travel of the sinuously formed wire to said wire severing means, means for halting travel of the sinuously formed wire to said wire severing means and including a magnetic brake operable, incident to energization thereof, to prevent wire travel to said wire severing means and operable, incident to the absence of energization thereof, to permit wire travel to said wire severing means, and control means connected to said wire severing means and including means for generating countable electrical pulses in response to wire travel relative to said wire severing means, said pulse generating means including a sprocket which is rotatably supported by said frame and which is rotatable in accordance with wire travel relative to said wire severing means, said sprocket including a plurality of angularly spaced teeth, said control means also including a magnetic sensing mechanism supported by said frame adjacent said sprocket and operable, in response to passage therepast of said sprocket, to generate an electrical signal, said magnetic sensing mechanism including first and second magnetic sensors supported on said frame in angularly spaced relation to each other corresponding to the angular spacing of said sprocket teeth, said means for generating countable electrical pulses including a sensing circuit operable to generate a countable electrical pulse in response to receipt of signals from said first and second magnetic sensors, and said control means further including a counting circuit connected to said sensing circuit, to said wire severing means and to said magnetic brake and being operable to receive the countable electrical pulses and, in response to receipt of a predetermined number thereof, to generate actuating signals for energizing said magnetic brake to prevent rotation of said sprocket and for energizing said wire severing means through one cycle to sever the sinuously formed wire.

2. Apparatus in accordance with claim 1 wherein said magnetic sensors are adjustably positioned radially with respect to said sprocket.

3. Apparatus in accordance with claim 1 wherein said counting circuit includes manually adjustable means for variably selecting the number of countable pulses operable to effect generation of said actuating signals.

* * * * *